US012768188B2

(12) United States Patent
Simpson

(10) Patent No.: US 12,768,188 B2
(45) Date of Patent: Oct. 20, 2026

(54) METHOD OF ARCHITECTURE DESIGN AND CONSTRUCTION

(71) Applicant: Owner Gateways, LLC, Saint Augustine, FL (US)

(72) Inventor: Michael Peter Simpson, Saint Augustine, FL (US)

(73) Assignee: Owner Gateways, LLC

( * ) Notice: Subject to any disclaimer, the term of this patent is extended or adjusted under 35 U.S.C. 154(b) by 319 days.

(21) Appl. No.: 18/401,207

(22) Filed: Dec. 29, 2023

(65) Prior Publication Data

US 2024/0218691 A1 Jul. 4, 2024

Related U.S. Application Data

(60) Provisional application No. 63/436,105, filed on Dec. 30, 2022.

(51) Int. Cl.
*E04H 6/02* (2006.01)

(52) U.S. Cl.
CPC ..... *E04H 6/02* (2013.01)

(58) Field of Classification Search
CPC .. E04H 6/005; E04H 6/02; E04H 6/08; E04H 6/10
See application file for complete search history.

(56) References Cited

U.S. PATENT DOCUMENTS 4,015,385 A * 4/1977 Pulte ..... E04H 14/00 52/236.6
5,265,384 A * 11/1993 Menke ..... E04H 3/08 52/79.8
9,097,030 B1 * 8/2015 Manterfield ..... E04B 1/34869
2004/0206011 A1 * 10/2004 Meeker ..... E04B 1/34869 4/663
2004/0226226 A1 * 11/2004 Krauth ..... E04H 6/02 52/79.1
2010/0257108 A1 * 10/2010 Skeels, IV ..... G06Q 50/163 235/494

(Continued)

OTHER PUBLICATIONS

Exploring Alternatives, Garage Converted into Amazing Modern Living Space—Tiny Home Tour, Dec. 19, 2020, https://www.youtube.com/watch?v=t9kle5Abfyw (Year: 2020).*

(Continued)

*Primary Examiner* — Kyle J. Walraed-Sullivan
(74) *Attorney, Agent, or Firm* — Lippes Mathias LLP; Mitchell Ghaneie; Josephine Chen

(57) ABSTRACT

The present disclosure provides a method for the architectural design and construction of a garage for a residential structure. The method includes identifying one or more exterior architectural design elements of the residential structure and identifying one or more interior architectural design elements of the residential structure. The plurality of steps further includes generating a design of the garage for the residential structure by incorporating one or more of said identified exterior architectural design elements in the enclosed space within the garage and incorporating one or more of said identified interior architectural design elements in the enclosed space within the garage. The plurality of steps further includes constructing the garage for the residential structure based on the design of the garage.

20 Claims, 5 Drawing Sheets

(56) References Cited

U.S. PATENT DOCUMENTS

| | | | | |
|---|---|---|---|---|
| 2016/0348385 | A1* | 12/2016 | Bottarelli | E04H 1/04 |
| 2018/0291615 | A1* | 10/2018 | Baker | E04B 1/34869 |
| 2018/0374276 | A1* | 12/2018 | Powers | G06T 17/205 |
| 2020/0362579 | A1* | 11/2020 | Baker | G06Q 50/12 |
| 2023/0148153 | A1* | 5/2023 | Jobson | E04H 6/02 52/79.7 |
| 2023/0219620 | A1* | 7/2023 | Miao | B62D 15/0285 340/932.2 |
| 2024/0218691 | A1* | 7/2024 | Simpson | E04H 6/02 |

OTHER PUBLICATIONS

Maxable, Storage Space to Stunning Studio with a Loft | Garage Conversion ADU Tour | Maxable, Oct. 5, 2021, https://www.youtube.com/watch?v=2TwuJ2DxZO0 (Year: 2021).*

* cited by examiner

METHOD OF ARCHITECTURE DESIGN AND CONSTRUCTION

CROSS-REFERENCE TO RELATED APPLICATION

This application claims the benefit of U.S. Provisional Application No. 63/436,105, filed Dec. 30, 2022, and is hereby incorporated by reference in its entirety for all purposes.

FIELD OF INVENTION

This invention is generally related to architecture and more specifically related to an architectural design and construction method for a residential garage.

BACKGROUND

Many homeowners live in residential structures which include a conventional attached garage. Such homeowners often use a garage entryway within the attached garage, as their primary entryway into their home. Front entryways of residential structures often include more ornamental features and architectural design elements that create a more visually appealing experience relative to a garage entryway within conventional attached garages. However, since many homeowners do not routinely use the front entryway of the residential structure, they fail to routinely experience a variety of benefits of entering their home through a visually appealing entryway.

The design of the interior of conventional attached garages is typically not afforded as much consideration, nor investment, as other spaces within the residential structure. As a result, conventional attached garages are often austerely finished, poorly lit, and uncomfortably confined. Consequently, the function of the conventional attached garage has traditionally been relegated to a subordinate utilitarian storage space that many homeowners strive to conceal from public view. While some custom designed homes may incorporate more architectural elements in the design of an attached garage, the curation of the design is unstandardized.

Accordingly, what is needed is an efficient standardized method for providing an aesthetic design of the enclosed space within an attached garage of a residential structure by coalescing the design aesthetics of the exterior and interior architectural designs of the residential structure.

BRIEF SUMMARY OF THE INVENTION

The following presents a simplified summary of the present disclosure in order to provide a basic understanding of some aspects of the invention. The summary is not an extensive or exhaustive overview of the invention and is not intended to identify all key or critical elements of the invention or to delineate the scope of the invention. The following summary merely presents some concepts of the invention in a simplified form as a prelude to the more detailed description provided below.

In general, the present disclosure provides a method of architectural design and construction of a garage for a residential structure. The method of architectural design and construction of a garage for a residential structure, hereinafter referred to as the "design and construction method," comprises a plurality of steps which deliberately blends a variety of interior and exterior architectural design elements within the interior of the garage. The garage may comprise an attached garage or a detached garage. The design and construction method efficiently standardizes the design construction of the enclosed space within the garage.

The plurality of steps includes identifying one or more exterior architectural design elements of the residential structure and identifying one or more interior architectural design elements of the residential structure. The plurality of steps further includes generating a design of the garage for the residential structure by incorporating one or more of said identified exterior architectural design elements in the enclosed space within the garage and incorporating one or more of said identified interior architectural design elements in the enclosed space within the garage. The plurality of steps further includes constructing the garage for the residential structure based on the design of the garage.

The design and construction method improves the efficiency of the architectural design of the garage, thus reducing the time and costs associated with the design and construction. It is anticipated that the plurality of steps may optionally include architectural design elements for the exterior access doors which are operably configurable to open to provide access for one or more vehicles to enter or exit the garage.

REFERENCE NUMBERS

1—Non-Limiting Exemplary Design and Construction Method
2—Garage
3—Residential Structure
5—Exterior Access Openings
6—Exterior Access Doors
10A—Primary Exterior Wall Surface Material
10B—Secondary Exterior Wall Surface Material
11—Front Wall
12—Back Wall
13—Side Walls
20—Skylight
30—Garage Entryway
35—Door
40—Flooring Material Transition Line
41—First Flooring Material
42—Second Flooring Material
50—Set of Recessed Cabinets
60—Cabinet Island

DETAILED DESCRIPTION OF THE EMBODIMENTS

In general, the present disclosure provides a nonlimiting, exemplary method of architectural design and construction of a garage 2 for a residential structure 3. The method of architectural design and construction of the garage 2 for the residential structure 3 is referred to herein as the "design and construction method 1" and may be attributable to the design of architectural design elements located on the exterior or interior of a garage 2. The garage 2 may comprise an attached garage or a detached garage. The design and construction method 1 comprises a plurality of steps which blends a variety of interior and exterior architectural design elements within the enclosed space of the garage 2. The design and construction method 1 efficiently standardizes the design and construction of an enclosed space within the garage 2.

Figure 2:
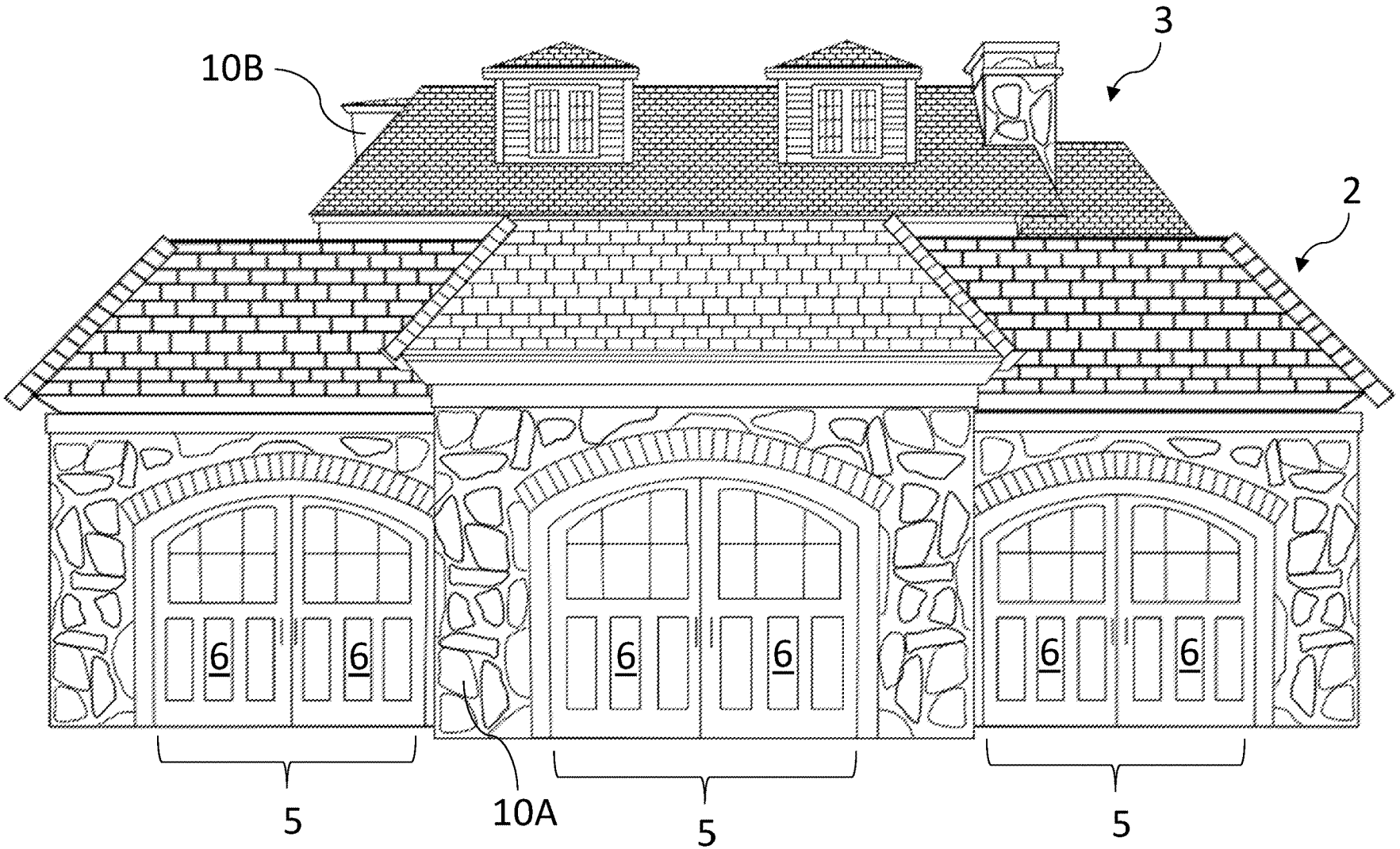
FIG. 2 is a rendering of a first exterior side elevation of the garage for the residential structure with a plurality of exterior access doors shown in a closed position.
Figure 3:
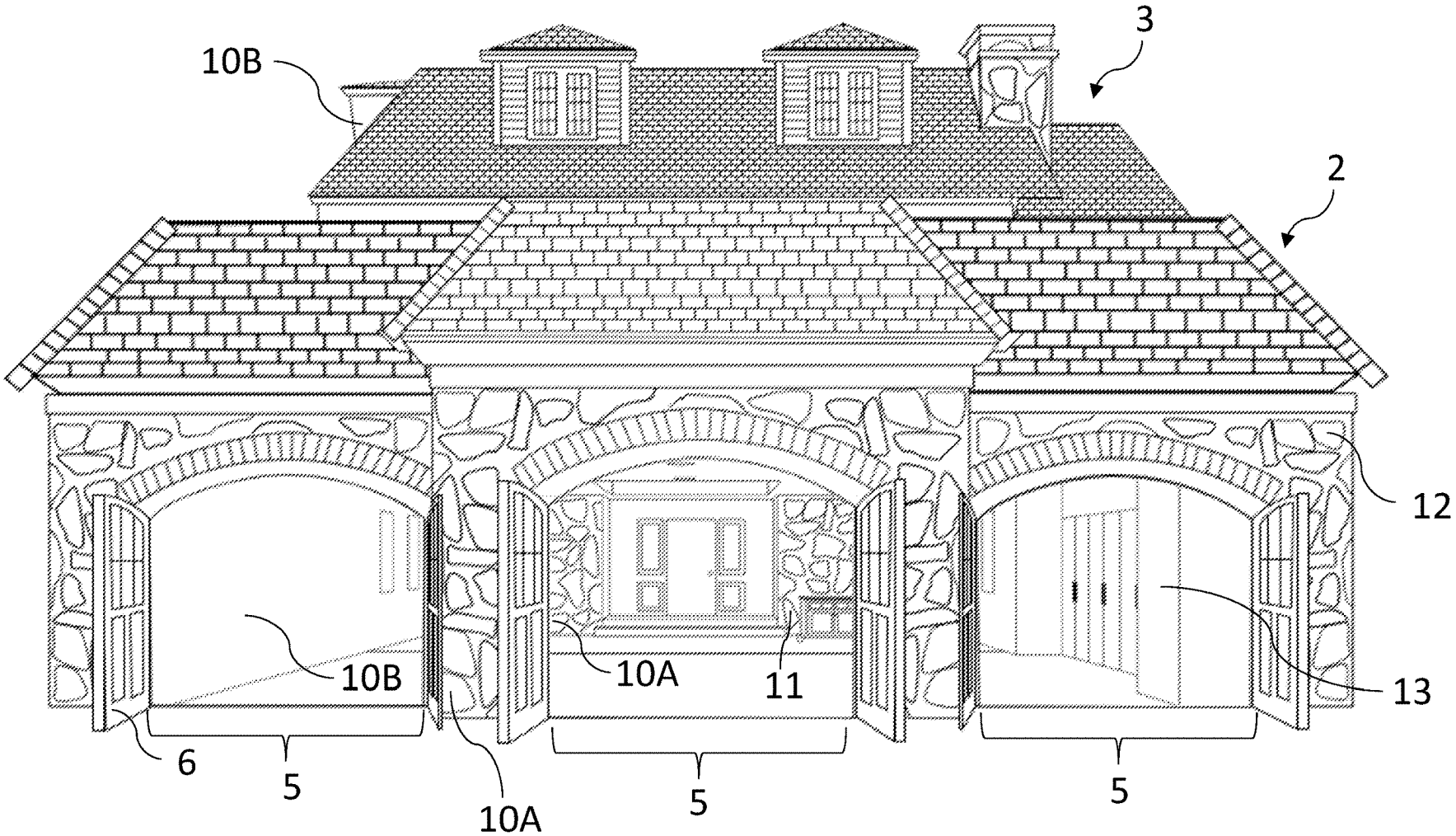
FIG. 3 is the rendering of FIG. 2 with the exterior access doors shown in an open position.

The residential structure 3 further includes one or more exterior wall surface materials, a front entryway (not shown), a foyer (not shown), and a kitchen (not shown). The front entryway provides a front door, and the kitchen provides cabinetry that has architectural trim work. The garage 2 includes a plurality of interior walls which include a front wall 11, a back wall 12, and two side walls 13, as shown in FIG. 3. The front wall 11 is adjacent to the residential structure 3 and the back wall 12 is opposite from the front wall 11. The back wall 12 includes a plurality of exterior access openings 5, each of which provide one or more exterior access doors 6, as shown in FIG. 2. Each exterior access opening 5 has a preferable width of at least 10 feet. It is further understood that the one or more exterior access doors 6 may each be configured to be oriented in a closed or open position, as shown in FIGS. 2 and 3, respectively.

Figure 1:
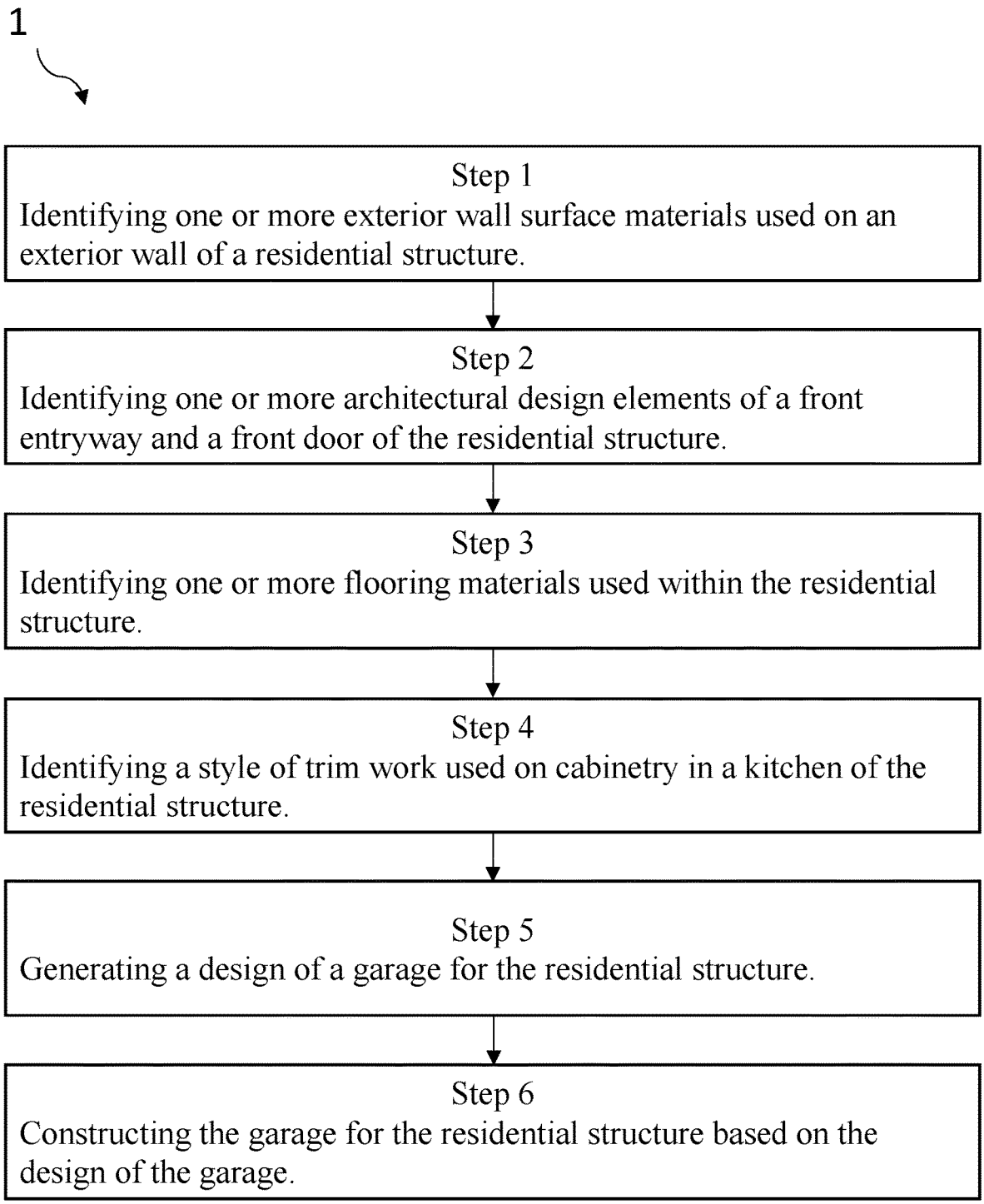
FIG. 1 is a schematic flowchart illustrating a non-limiting exemplary embodiment of a method of architecture design and construction of a garage for a residential structure.

The design and construction method 1 includes a plurality of steps; a non-limiting exemplary embodiment of which is schematically depicted in FIG. 1. The first step of the plurality of steps includes identifying one or more exterior wall surface materials used on an exterior wall of a residential structure 3. The residential structure 3 may have more than one type of exterior wall surface including a primary wall surface 10A and a secondary wall surface 10B.

The second step of the plurality of steps includes identifying one or more architectural design elements of a front entryway and a front door of the residential structure 3. The one or more architectural design elements may derive from various architectural styles, including but not limited to traditional, modern, contemporary, mid-century modern, Victorian, cottage, rustic, mediterranean, eclectic, industrial, coastal, alpine and desertic. Depending on the style of the architecture, the one or more architectural design elements may include symmetrical designs, columns, pediments, woodworks, arches, decorative wrought iron, minimalistic features, clean lines, half-timber, and may utilize unique materials such as metal, glass, or stones.

The third step of the plurality of steps includes identifying one or more flooring materials, such as a kitchen flooring material or a foyer flooring material, used within the residential structure 3.

The fourth step of the plurality of steps includes identifying a style of trim work used on cabinetry in the kitchen of the residential structure. The style of trim work may include but is not limited to crown molding, starter molding, riser molding, base molding, light rail molding, and toe kick molding.

Figure 4:
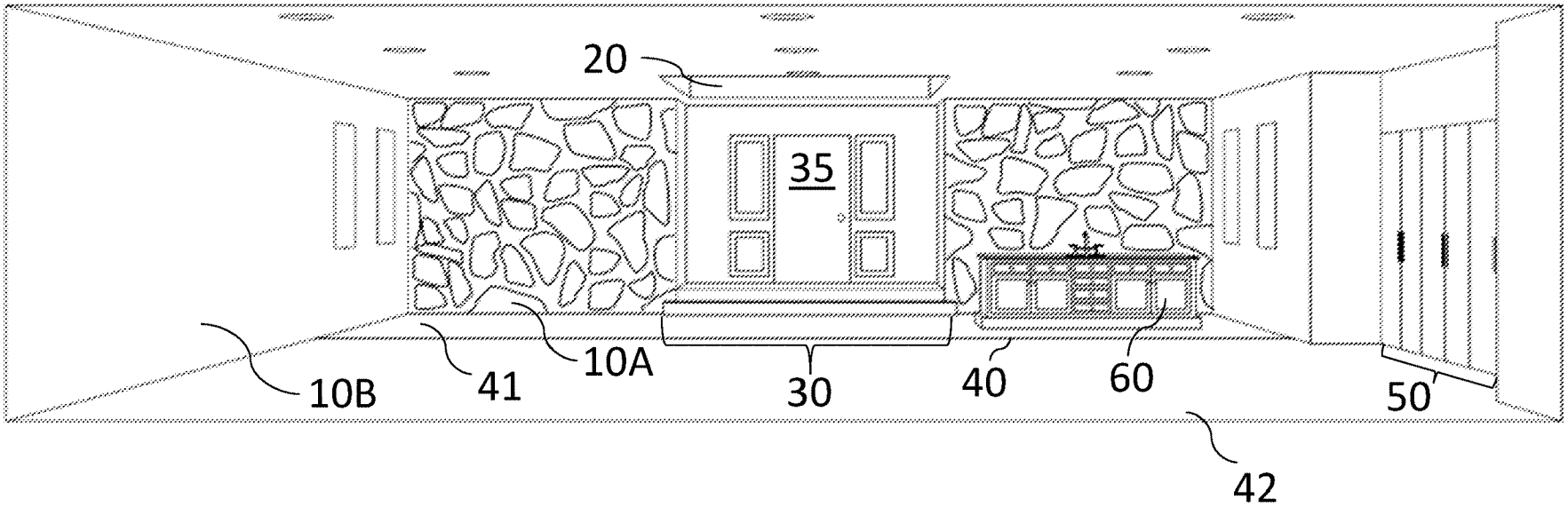
FIG. 4 is a rendering of a first interior perspective view of a non-limiting exemplary interior architectural design of the garage of the residential structure produced by the exemplary embodiment of the method of architecture design and construction of the garage of the residential structure.
Figure 5:
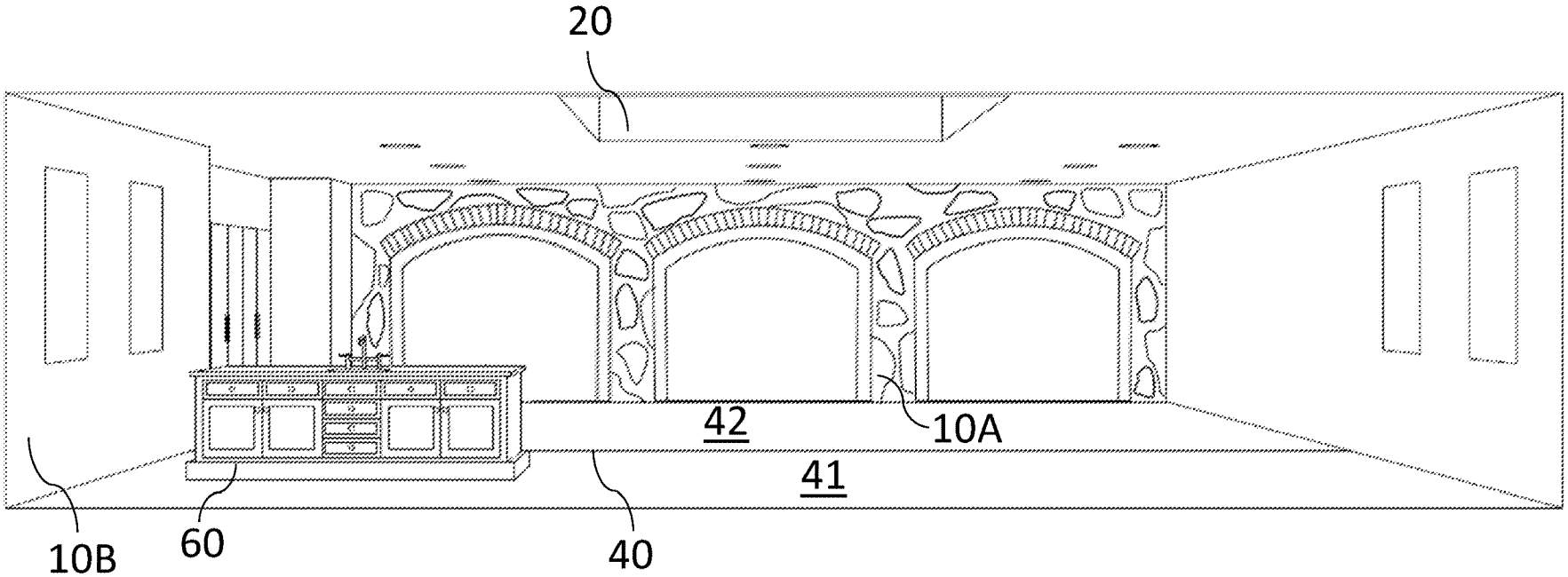
FIG. 5 is a rendering of a second interior perspective view of the non-limiting exemplary interior architectural design of the garage of the residential structure produced by the exemplary embodiment of the method of architecture design and construction of the garage of the residential structure.

The fourth step of the plurality of steps includes generating a design of the garage for the residential structure 3. It is anticipated that the design may be generated by a computer-aided design software. The design incorporated one or more of the identified exterior and interior architectural design elements in the enclosed space within the garage 2. The one or more of the plurality of interior walls are configured to be cladded with the one or more exterior wall surface materials of the residential structure 3. As shown in FIGS. 4 and 5, the plurality of interior walls are cladded with the primary exterior wall surface material 10A and the secondary exterior wall surface material 10B that is substantially identical to the primary exterior wall surface material 10A and the secondary exterior wall surface material 10B of the residential structure 3. Preferably, the plurality of interior walls are cladded with the one or more exterior wall surface materials by a predetermined percentage. In the exemplary embodiment, the one or more interior walls within the garage 2 of the residential structure 3 is cladded with the primary exterior wall surface material 10A such that at least a predetermined minimum percentage in the range of about 15 to 25 percent of the surface area of one or more of said interior walls are covered with said primary exterior wall surface material 10A. It is anticipated that a secondary exterior wall surface material 10B could be selected, and subsequently used to cover, or partially cover, one or more interior walls of the garage 2. When two exterior wall surface materials 10A, 10B are concurrently utilized, it is preferable that the front and back walls 11, 12 be cladded with the primary exterior wall surface material 10A and the two side walls 13 be cladded with the secondary exterior wall surface material 10B. Cladding the plurality of interior walls of the attached garage 2 with one or more exterior wall surface materials coalesces the design aesthetics of the exterior and interior 11 architectural designs of the residential structure 3.

Generating the design may also include selecting a location within the front wall 11 of the garage 2 for a garage entryway 30 to be located. It is preferable that the garage entryway 30 be 14 centered within the front wall 11 when there are an odd number of exterior access openings 5 within the back wall 12. Furthermore, it is preferable that the garage entryway 30 not be centered within the front wall 11 when the garage 2 comprises only two or even numbers of exterior access openings 5. Once said selection of the location of the garage entryway 30 is made, it is anticipated that said garage entryway 30 will be subsequently installed, or otherwise constructed, in the attached garage 2.

Generating the design may further include selecting a location for a door 35 to be placed within the garage entryway 30, wherein the door 35 includes one or more of the architectural design elements of the front door. Once said selection of the location of the door 35 is made, it is anticipated that said door 35 will be subsequently installed in the garage 2.

Next, generating the design includes selecting a location for a skylight 20 within the ceiling of the garage 2. As shown in FIG. 4, the garage entryway 30 is preferably elevated relative to the floor elevation of the floor of the garage 2 and is recessed relative to the interior wall of the garage 2 which it is located within. The garage entryway 30 preferably includes one or more architectural design elements of the front entryway. Furthermore, it is preferrable that the skylight 20 be aligned horizontally with the garage entryway 30 such that it is substantially centered with the garage entryway 30, as shown in FIG. 5. The skylight 20 provides natural overhead light which assists in positively influencing how the interior space provided by the garage 2 is perceived.

Once said selection of the skylight 20 is made, it is anticipated that said skylight 20 will be subsequently installed in the garage 2.

Further, generating the design includes selecting a location for a set of recessed cabinets 50 within one or more interior walls of the garage 2. Each set of recessed cabinets 50 is preferably trimmed with an architectural trim used within the interior of the residential structure 3 and located closer in proximity to the one or more exterior access openings 5 than the garage entryway 30. The set of recessed cabinets 50 are recessed relative to the side walls 13 of the garage 2 to provide additional space to access one or more cabinets of the set of recessed cabinets 50, which is often beneficial when a vehicle is parked directly adjacent to the cabinets 50. Once said selection of the recessed cabinets 50 is made, it is anticipated that said recessed cabinets 50 will be subsequently installed in the attached garage 2.

Next, generating the design includes selecting a first flooring material 41 and a second flooring material 42 which is suitable for exterior use for the garage 2. Preferably, the first flooring material 41 is substantially the same as the kitchen flooring material used within the kitchen of the residential structure 3. It is anticipated that the second flooring material 42 may to be substantially the same as the foyer flooring material which is utilized in the foyer of the residential structure 3. Once said selections of first flooring material 41 and second flooring material 42 are made, it is anticipated that said flooring materials 41, 42 will be subsequently installed in the attached garage 2.

Further, generating the design includes selecting a location for a flooring material transition line 40 within the attached garage 2. The flooring material transition line 40 demarcates the transition of the first flooring material 41 to the second flooring material 42, as shown in FIGS. 4 and 5. Additionally, it is preferred that the first flooring material 41 not cover more than 50 percent 6 of the total surface area of the floor of the garage 2.

Still further, generating the design includes selecting the location for at least one cabinet island 60. Preferably, the at least one cabinet island 60 is positioned on top of the first flooring material 41 within the garage 2 and incorporating said style of architectural trim work used on cabinetry in the kitchen of the residential structure 3 on one or more vertical surfaces of the cabinet island. The cabinet island 60 may further include a faucet and integrated plumbing. Once said selection of the location of the one or more cabinet islands 60 is made, it is anticipated that one or more cabinet islands 60 will be subsequently installed in the attached garage 2.

The fifth step of the plurality of steps includes constructing the garage 2 for the residential structure 3 based on the design of the garage.

It is anticipated that the plurality of steps may optionally include steps relating to the selection of architectural design elements for the exterior access doors 6. It is further anticipated that the plurality of steps may optionally include steps relating to lighting fixtures within the interior or exterior of the attached garage 2. It is further anticipated that the plurality of steps may include steps relating to the selection of architectural design elements for one or more windows located in the walls of the attached garage 2 and for one or more air supply grilles or return air registers located in the ceiling or walls. It is further anticipated that the design method 1 may include identifying and selecting a primary window assembly used within one or more exterior walls of the residential structure 3 and subsequently identifying one or more locations of one or more rough window openings within one or more interior walls of the attached garage 2 for said primary window assembly to be installed. It is further anticipated that the plurality of steps of the design method 1 may additionally include the utilization of radiant floor heating underneath the first flooring material 41.

It is further anticipated that the design method 1 may be utilized for detached garages which have a covered breezeway which leads to an auxiliary entrance to the residential structure 3.

While the foregoing exemplary non-limiting embodiment of the method for the architectural design of an attached garage for a residential structure have been disclosed herein, certain modifications, including, but not limited to, the order in which the design method's 1 steps are presented, may be made by those skilled in the art to modify the embodiment without departing from the spirit of the invention.

What is claimed is:

1. A method of architecture design and construction, comprising:

a) identifying one or more exterior wall surface materials used on an exterior wall of a residential structure;

b) identifying one or more architectural design elements of a front entryway and a front door of the residential structure;

c) identifying one or more flooring materials used within the residential structure;

d) identifying a style of trim work used on cabinetry in a kitchen of the residential structure;

e) in response to identifying the one or more exterior wall surface materials, generating a design of a plurality of interior walls comprising a front wall, a back wall and two side walls;

wherein the front wall is adjacent to the residential structure;

wherein one or more of the plurality of interior walls incorporates the one or more exterior wall surface materials identified from the residential structure;

wherein the plurality of interior walls are cladded with the one or more exterior wall surface materials by a predetermined percentage;

f) in response to identifying the one or more architectural design elements of a front entryway and a front door of the residential structure, generating a design of a garage door entry way, the garage door entry way positioned at the front wall and incorporating at least one of the one or more architectural design elements identified from the front entryway of the residential structure;

generating a design of at least one door, the at least one door positioned within the garage door entry way and incorporating the one or more architectural design elements identified from the front door of the residential structure;

g) in response to identifying the one or more flooring materials used within the residential structure, generating a design of a floor; the floor incorporating one or more flooring materials identified from the residential structure;

h) in response to identifying the style of trim work used on cabinetry in the kitchen of the residential structure, generating a design of a set of recessed cabinets; the set of recessed cabinets attached within one or more of the interior walls and incorporating the style of trim work used on the cabinetry in the kitchen of the residential structure; and i) constructing a garage for the residential structure based on steps a to h.

2. The method as described in claim 1, wherein the one or more exterior wall surface materials comprises a primary exterior wall surface material and a secondary exterior wall surface material.

3. The method as described in claim 2, wherein the plurality of interior walls are covered by the primary exterior wall surface material by 15 percent to 25 percent.

4. The method as described in claim 2, wherein the front wall and the back wall are cladded by the primary exterior wall surface material, and the two side walls are cladded with the secondary exterior wall surface material.

5. The method as described in claim 1, wherein the design of the garage further comprises one or more exterior access openings within the back wall.

6. The method as described in claim 5, wherein a number of the one or more of exterior access openings is in odd numbers, the garage entryway is centered within the front wall.

7. The method as described in claim 5, wherein a number of the one or more of exterior access openings is in even numbers, the garage entryway is off centered within the front wall.

8. The method as described in claim 5, wherein the set of recessed cabinet is located closer in proximity to the one or more exterior access openings than the garage entryway.

9. The method as described in claim 1, wherein the design of the garage further comprises a skylight within a ceiling of the garage.

10. The method as described in claim 9, wherein the skylight is aligned horizontally with the garage entryway.

11. The method as described in claim 1, wherein the garage entryway is elevated relative to an elevation of the floor.

12. The method as described in claim 1, wherein the garage entryway is recessed relative to the front wall.

13. The method as described in claim 1, wherein the one or more flooring materials comprises a first flooring material and a second flooring material.

14. The method as described in claim 13, wherein the method further comprises identifying a kitchen flooring material of the residential structure; and installing the first flooring material to be substantially the same as the kitchen flooring material.

15. The method as described in claim 14, wherein the first flooring material covers less than 50 percent of a total surface of the floor.

16. The method as described in claim 13, wherein the method further comprises identifying a foyer flooring material of the residential structure, and installing the second flooring material to be substantially the same as the foyer flooring material.

17. The method as described in claim 1, wherein the floor comprises a flooring material transition line, and wherein the flooring material transition line demarcates transition of a first flooring material to a second flooring material.

18. The method as described in claim 1, wherein the design of the garage further comprises at least one cabinet island; and wherein the at least one cabinet island comprises incorporates the style of trim work used on the cabinetry in the kitchen of the residential structure.

19. The method as described in claim 18, wherein the one or more flooring materials comprises a first flooring material and a second flooring material; wherein the method further comprises identifying a kitchen flooring material of the residential structure; installing the first flooring material to be substantially the same as the kitchen flooring material; and wherein the one or more cabinet island is positioned on the first flooring material.

20. The method as described in claim 1, wherein the garage comprises an attached garage or a detached garage.

* * * * *